US006884136B1

(12) United States Patent
McCarthy

(10) Patent No.: US 6,884,136 B1
(45) Date of Patent: Apr. 26, 2005

(54) DUAL ADJUSTABLE STRAP DESIGNS FOR SWIM FINS

(76) Inventor: Peter T. McCarthy, 26810 Pine Cliff Pl., Valencia, CA (US) 91381

( * ) Notice: Subject to any disclaimer, the term of this patent is extended or adjusted under 35 U.S.C. 154(b) by 0 days.

(21) Appl. No.: 10/760,514

(22) Filed: Jan. 20, 2004

(51) Int. Cl.[7] ..... A63B 31/08
(52) U.S. Cl. ..... 441/64
(58) Field of Search ..... 441/60–64; D21/806; 36/8.1, 117.1

(56) References Cited

U.S. PATENT DOCUMENTS

| | | | | | |
|---|---|---|---|---|---|
| 1,607,857 | A * | 11/1926 | Zukal | 441/64 |
| 2,343,468 | A * | 3/1944 | Messinger | 441/64 |
| 2,903,719 | A * | 9/1959 | Wozeneraft | 441/64 |
| 4,795,385 | A | 1/1989 | Matsuoka | |
| 4,832,644 | A * | 5/1989 | Roberts | 441/64 |
| 5,183,424 | A * | 2/1993 | Field | 441/64 |
| 5,597,336 | A * | 1/1997 | Evans | 441/64 |
| 5,868,592 | A * | 2/1999 | Bulin et al. | 441/64 |
| 5,960,565 | A * | 10/1999 | Lochbaum | 36/8.1 |
| 5,966,843 | A * | 10/1999 | Sand et al. | 36/117.1 |
| 6,237,250 | B1 * | 5/2001 | Aguerre | 36/11.5 |
| 6,663,452 | B1 * | 12/2003 | Myers | 441/64 |
| 2002/0037677 | A1 * | 3/2002 | Gibbons et al. | 441/64 |

* cited by examiner

*Primary Examiner*—Stephen Avila
(74) *Attorney, Agent, or Firm*—Knobbe Martens Olson & Bear LLP

(57) ABSTRACT

An improved adjustable heel strap having an adjustable instep strap connected to the heel strap adjacent the heel portion of a swimmer' foot. Methods are provided for providing a highly adjustable strap system for preventing loss of swim fins in rough water conditions such as large surf and large open ocean waves. Methods are also provided for providing multi-dimensional heel strap adjustability around the ankle and instep to reduce ankle strain, increase ankle support, distribute load and stress points, reduce chaffing and blisters, increase leverage and power to the swim fin, reduce looseness and play between the foot and the swim fin, to increase comfort, to increase control, to improve positioning control, to improve sizing adjustment and to provide increased conformity to greater variations in foot and ankle sizes, shapes and contours. Methods are also provided for providing dual adjustable heel straps and instep straps having sufficient quick release capabilities for permitting the swim fin to be put on and taken off quickly and easily while in the water, including while in rough water conditions.

21 Claims, 2 Drawing Sheets

DUAL ADJUSTABLE STRAP DESIGNS FOR SWIM FINS

BACKGROUND

1. Field of Invention

This invention relates to foot strap structures, and more specifically to foot strap structures for swim fins.

2. Description of Prior Art

Prior art swim fin strap structures do not offer adequate sizing adjustability and adjustable security harness structures to prevent loss of the swim fin during rough water conditions such as heavy surf. Prior art tethers used as security devices for prevention of loss of surf fins are designed for surf fins having non-adjustable heel straps that are permanently molded to one size. Non-adjustable heel straps prevent compensation for slight variations in size and also do not allow for preferences in the degree of tightness of such heel straps. Such prior art tethers are also difficult to take off in the water and the user often must walk up onto dry land while still wearing the fins before being able to disconnect the tether and then remove the fin. For the same reasons, many such devices must be put one and engaged while on dry land. Both of these situations are undesirable since wading in water is more difficult while wearing fins. The play between the user's foot and the foot pocket due to the lack of sufficient adjustability with non-adjustable surf fin heel straps cause significantly reduced propulsion during kicking strokes as well as chaffing of the skin, bruises and blisters, especially in rough water conditions. The occurrence of chaffing, bruises and blisters can greatly reduced endurance and enjoyment. Prior art straps also do not properly address the need for multi-dimensional adjustable support of the ankle region during strenuous kicking strokes.

Prior art adjustable heel straps are highly susceptible to loss in high surf conditions as the flexible strap material is easily pulled down the heel and off the foot by large waves. This is particularly a problem with bare feet or fin socks that lack a thick and rigid rubber sole.

OBJECTS AND ADVANTAGES

Accordingly, several objects and advantages of the present invention are:

(a) to provide swim fin adjustable strap structures that are easy to put on and take off in the water;

(b) to provide swim fin adjustable strap structures having increased security for prevention of loss of fins in rough water conditions such as large surf and large open ocean waves;

(c) to provide swim fin adjustable strap structures that are adjustable in multiple ways and dimensions relative to the user's ankle, including sizing, tightness, security, comfort and positioning;

(d) to provide swim fin adjustable strap structures that reduce play between the foot and the swim fin with improved adjustability and support, thus increasing propulsion efficiency by reducing lost motion, chaffing and blisters;

(e) to provide swim fin adjustable strap structures that can be adjusted in the water to provide fine-tuned fit around the heel and ankle for maximum security, efficiency, and comfort;

(f) to provide swim fin adjustable strap structures that provide a more solid grip around the ankle so that increased leverage can be applied to the swim fin blade for increased power, speed, torque and control;

(g) to provide swim fin adjustable strap structures that permit surf fins to be made with injection molded thermoplastics for increased manufacturing efficiency and style while also providing improved security from losing such surf fins in large surf or large wave conditions;

(h) to provide swim fin adjustable strap structures that have sufficient adjustability to permit a lower quantity of foot pocket cavity sizes to fit a larger array of foot sizes and shapes;

(i) to provide improved ankle support with adjustability on both the heel and the instep of the ankle;

(j) to provide swim fin adjustable strap structures having adjustability in numerous dimensions for improved comfort, adaptability, and support;

(k) to provide improved leverage on the swim fin blade during kicking from the instep portion of the ankle through adjustable strap structures that can be adjusted on both sides of the ankle to significantly reduce loose play between the blade and the ankle; and (l) to provide dual adjustable heel strap and instep strap foot attachment assemblies that permit each portion to be easily adjusted without impeding the function or adjustment of the other portion.

Still further objects and objectives will become apparent from a consideration of the ensuing description and drawings.

DRAWING FIGURES

DESCRIPTION AND OPERATION—FIGS. 1–3

Figure 1:
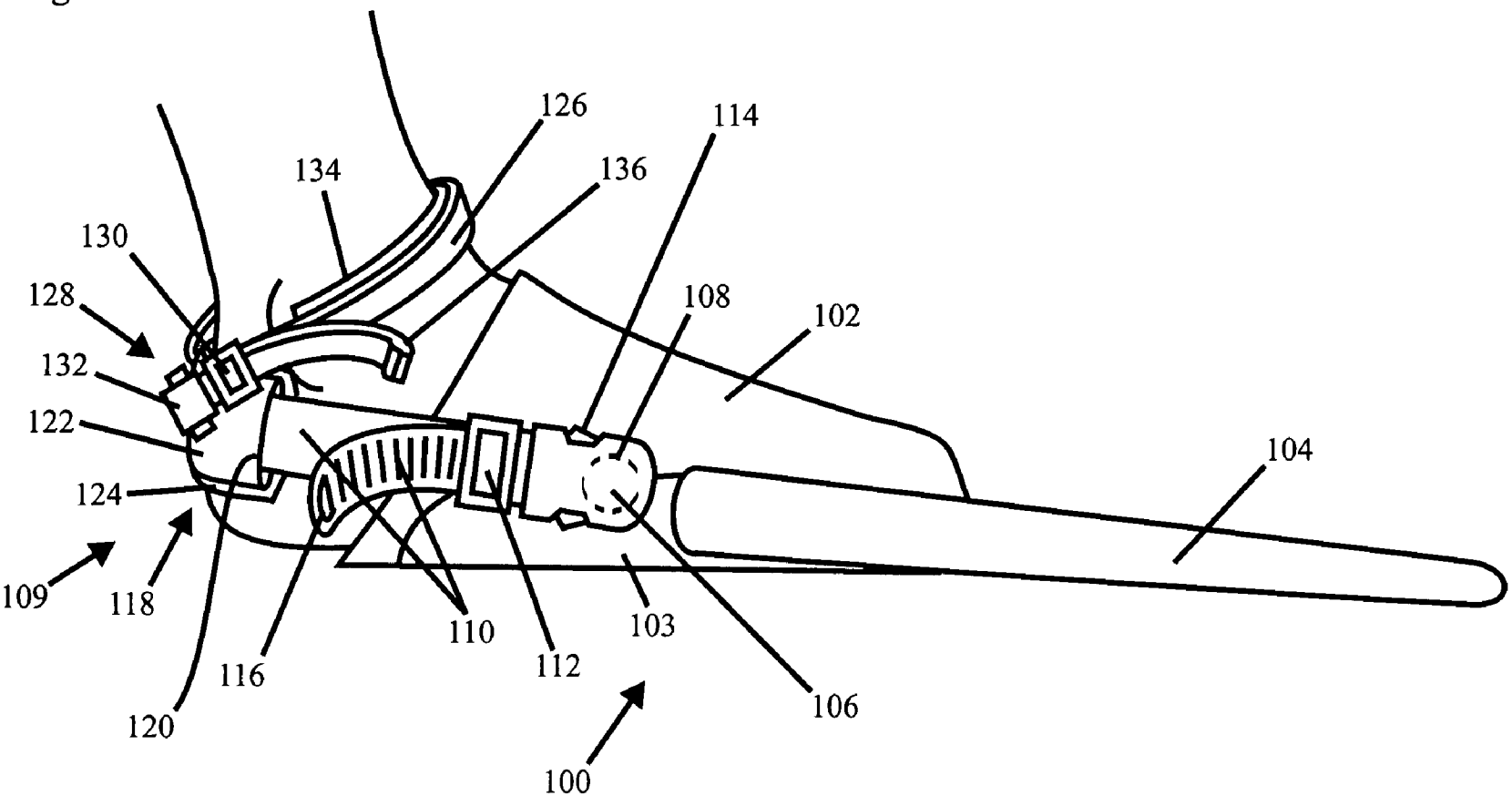
FIG. 1 shows a perspective side view of a swim fin having a dual adjustable heel strap and instep strap.

FIG. 1 shows a perspective side view of a swim fin having a dual adjustable heel strap and instep strap. An adjustable swim fin 100 is seen to have a foot pocket 102, a stiffer region 103, a blade 104, a post connector 106 shown by a dotted line to be behind a buckle connector 108, and an adjustable buckle assembly 109. Foot pocket 102 is preferably made with a thermoplastic material that is injection molded; however, it may be made with any material or processes. These include compression molded rubber or fabric materials secured with chemical or mechanical bonds. Foot pocket 102 may also be made to be adjustable. Stiffer portion 103 is preferably made with a more rigid material than used for foot pocket 102 in order to provide support to the foot pocket for energy transference to blade 104 as well as structural support for post connector 106, which is also preferably made with a relatively stiff material. However portion 103 may also be made with the same material as foot pocket 102 or more flexible materials as well. Post 106 is seen to be behind connector 108; however, post 106 may be positioned and secured to connector 108 in any desirable manner. Post 106 is seen to have a round shape; however, post 106 may have any desired shape. Buckle connector 108 is used to secure a strap 110 to swim fin 100. Buckle connector 108 may also take any desired form and may provide any desired method of connecting strap 110 to swim fin 100. This includes, rivets, snaps, locks, hooks, chemical bonds, mechanical bonds or any other desired method.

An adjustable buckle 112 is secured to connector 108 in any desired manner. Buckle 112 and 108 may alternatively be made as the same part. Buckle 112 is preferably connected to connector 108 with a quick release connector 114, part of which is shown extending from an opening in connector 108. Buckle 112 preferably permits two-way adjustment of the length and tension of strap 110. A heel strap end 116 preferably has a blocking device, such as a bump, fold, or other suitable blocking feature that prevents strap 110 from unintentionally slipping through buckle 112 and becoming unintentionally disengaged. Preferably, strap 110 is tightened by pulling on strap end 116 and loosened by manipulating the release of tension via buckle 112 in any desired; however, it is preferred that release of tension is accomplished by depressing or lifting a release button or lever. Buckle 112 is preferably made with a thermoplastic material but may be made with any desired material including metals. Strap 110 may be secured to swim fin 110 with any adjustable mechanism desired, including the use of D-rings, cam connectors, loops, hook and loop fasteners, buttons, snaps, ties or any other suitable adjustment mechanisms. Strap 110 is preferably made with a fabric, a thermoplastic elastomer, a thermoplastic rubber, a compression-molded rubber, a plastic, or a woven material; however, any desired material may be used.

Strap 110 is seen to pass through a heel pad assembly 118. Heel pad assembly 118 preferably has a sleeve opening 120 for receiving strap 110; however any method of attaching strap 110 to pad 118 may be used. Sleeve 120 is preferably made of fabric or woven material sewn together; however, any material and method of connection or fabrication may be used. This may include fasteners, clasps, ties, loops, folds, hook and loop fasteners or any other suitable devices. While it is preferred that sleeve 120 permits strap 110 to move within pad 118 for maximum adjustability, pad 118 may be secured to strap 110 in any desired manner that is either movable, non-movable or permanent. If pad 118 is not sufficiently movable relative to strap 110, then if the user tightens heel strap end 116 only on one side of swim fin 100, or pulls more on one side of swim fin 100 than on the other side, then pad 118 will to shift over toward that side of swim fin 100 that has been pulled further pad 118 will shift off center of the user's heel. By permitting pad 118 to be movable along strap 118, the positioning of pad 118 along the center of the user's heel can be adjusted and, or maintained if heel strap end 116 is pulled on only one side of the fin, or more on one side than the other.

The side edge of pad 118 is seen to be separated from buckle 112 by a significant distance to allow easy adjustment of tension within strap 110 while significantly preventing pad 118 from pushing against or jamming within buckle 112 during such adjustments in tension. When tension is increased, pad 118 is spaced from buckle 112 and does not impede the function of buckle 112 during adjustment. While it is preferred that pad 118 be located at the rear heel portion of the user's foot, alternate embodiments could place pad 118 to at least one side of the user's heel, both sides of the user's heel, or both sides and the back of the user's heel, preferably at a sufficient distance from buckle 112 to prevent jamming. Pad 118 is seen to have an outside surface 122 and a cushion 124 between strap 110 and the user's heel. Cushion 124 is preferably made with fabric covered neoprene foam, a padded fabric, rubberized fabric, fabric covered rubber, foam rubber, foam elastomer, or any other suitable padded material. Preferably, cushion 124 has sufficient padding to increase comfort and reduce chaffing or pressure points from strap 110. Cushion 124 may be secured to pad 118 in any desirable manner such as stitching, snaps, hook and loop fasteners, An instep strap 126 is connected to pad 118 with an adjustable buckle 128 for adjusting the sizing and tension of instep strap 126. Strap 126 is preferably made with a woven material, but other materials may be used as well, including thermoplastic materials, rubber, rubber-like materials, or any desired material. In alternate embodiments, buckle 128 may employ any adjustable mechanism desired, including the use of D-rings, cam connectors, loops, hook and loop fasteners, buttons, snaps, ties or any other suitable adjustment mechanisms. Buckle 128 is preferably secured to pad 118 with a quick release connector 132 to provide quick and easy release of instep strap 118 while in the water if desired. This permits the fins to be easily secured and taken off while in the water and prevents the user from having to wade long distances in and out of the water with fins on. In alternate embodiments, both ends of instep strap 126 may have quick disconnect devices to permit instep strap 126 to be completely removed when water conditions are not rough or when additional ankle support is not desired. Other alternate embodiments can be used without any quick release devices whatsoever if desired. An instep cushion 134 is secured to instep strap 126 adjacent the instep region of the user's ankle or foot. Pad 134 may be made with fabric covered neoprene foam and sewn to instep strap 126; however, any material or method of connection may be used. An instep strap end 136 preferably has a bump, fold, knob, or other suitable stopping device that prevents instep strap end 136 from slipping through buckle 130 unintentionally.

The user may easily pull on heel strap end 116 to create desired fit and tension around the back of the heel and then pull on instep strap end 136 to create desired tension and fit around the front of the user's ankle and instep region. Together, this provides a dramatic improvement in security, fit, comfort, and feel. In addition, by loosening heel strap 110 slightly with buckle 112 and then tightening instep strap end 136, the position of heel pad 118 is elevated higher on the user's heel for changes in comfort, leverage, feel, and for adapting to variations in foot shape and contour. By slightly loosening instep strap 126 with an adjustment to buckle 130, heel pad 118 may be lowered on the user's ankle for further positioning adjustment. Because instep strap 126 is able to prevent the highly flexible heel strap 110 from falling down the heel and off the foot during use, the swim fin cannot be lost even in the roughest surf conditions. By creating similar tension between instep strap 126 and heel strap 110 so that both are optimally snug and fit for a particular user's foot, increased support of the ankle region is achieved.

As the user kicks swim fin 100 forward (instep leading the direction of kick), tension exerted on heel pad 118 is immediately transferred to instep strap 126 and from instep strap 126 to the front of the user's ankle and instep region. This allows significantly more leverage to be exerted on blade 104 for increased propulsive power and efficiency. By having adjusted support and fit around both the instep and the heel, loads are distributed over both regions and reduced upon the Achilles tendon. Because instep strap 126 connects to heel pad 118 at the rear portion of the user's heel, instep strap 126 wraps around the entire ankle region and provides even support to the sides of the user's ankle as well for increased support, comfort and security. This redistributes the load around the entire ankle for increased support and reduced pressure points. When both heel strap 110 and instep strap 126 are adjusted for optimum contouring, fit, tension, comfort, and support, loose play between the user's foot and swim fin 100 is greatly reduced or even eliminated entirely. This greatly reduces chaffing and blisters on the user's foot within foot pocket 102. This can significantly increase the swimmer's ability to kick hard and fast for long durations in high surf conditions with reduced discomfort and pain. The fully adjustable circum ankle support and distributed tension reduces ankle fatigue and strain to tendons and ligaments, especially during the demands of swimming in high surf conditions. In addition to use on surf fins, the methods of the present invention may also be used on any desired swim fin. This includes snorkel fins, triathlon fins, fitness fins, free diving fins, monofins, beach rescue fins, ocean rescue fins, and scuba fins.

Figure 2:
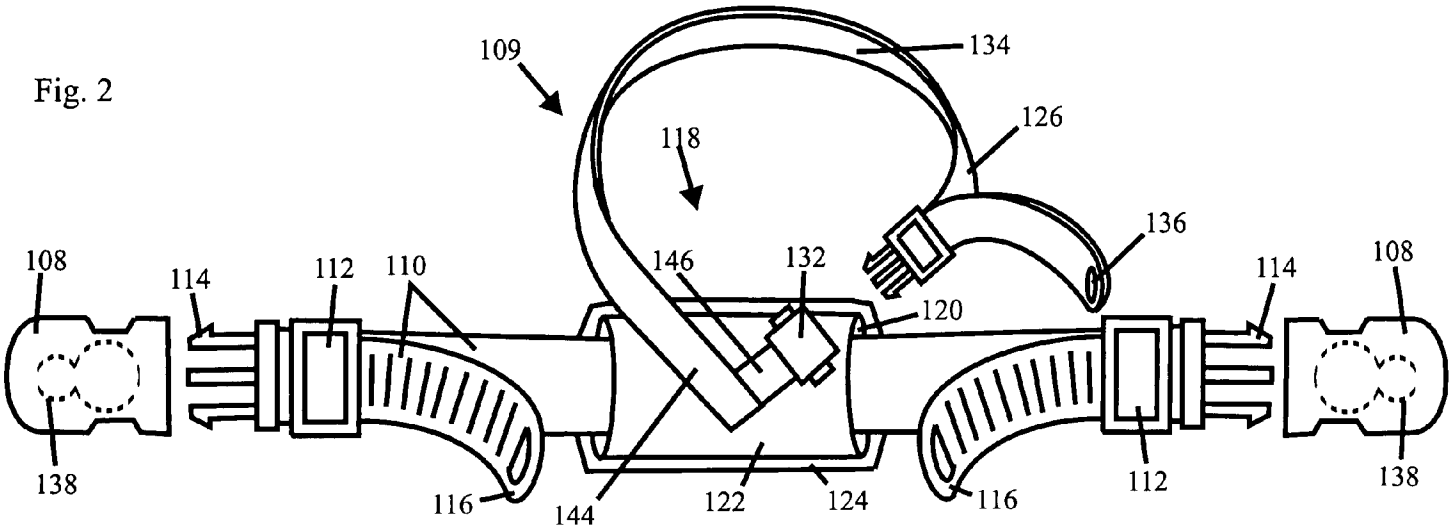
FIG. 2 shows a rear view of the same dual adjustable heel strap and instep strap shown in FIG. 1.

FIG. 2 shows a rear view of the same dual adjustable heel strap and instep strap shown in FIG. 1, except that the strap assemblies have been removed from swim fin 100 in FIG. 1. In FIG. 2, quick release connectors 114 are disconnected from buckle connectors 108 in order to show that connectors 114 are preferably three pronged connectors. However, any type of quick release connection may be used. Connectors 114 are male fittings and connectors 108 are female fittings. Although it is preferable that the entire strap assembly be removable from a swim fin, alternate embodiments can have at least one portion of the assembly either have a permanent connection, semi-permanent connection, or non-quick release connection to the swim fin. Dotted lines within buckle connector 108 show that the opposite side of connector 108 has a post-receiving cavity 138 that is designed to receive and interlock with a post structure secured to a swim fin. Post-receiving cavity 138 and its corresponding post structure located on the swim fin may have any desired shape, configuration or method of connection. Buckle 130 is seen to have a quick release male connector 140 that has been disconnected from connector 132, which is a female connector. Connector 132 is connected to pad 118 with a strap base 142 that is preferably made with a fabric material and sewn to pad 118; however, connector 132 may be connected to pad 118 in any desired manner. Strap 126 is seen to have an instep strap base 144, which is preferably sewn to pad 118; however, any method of connection may be used.

Figure 3:
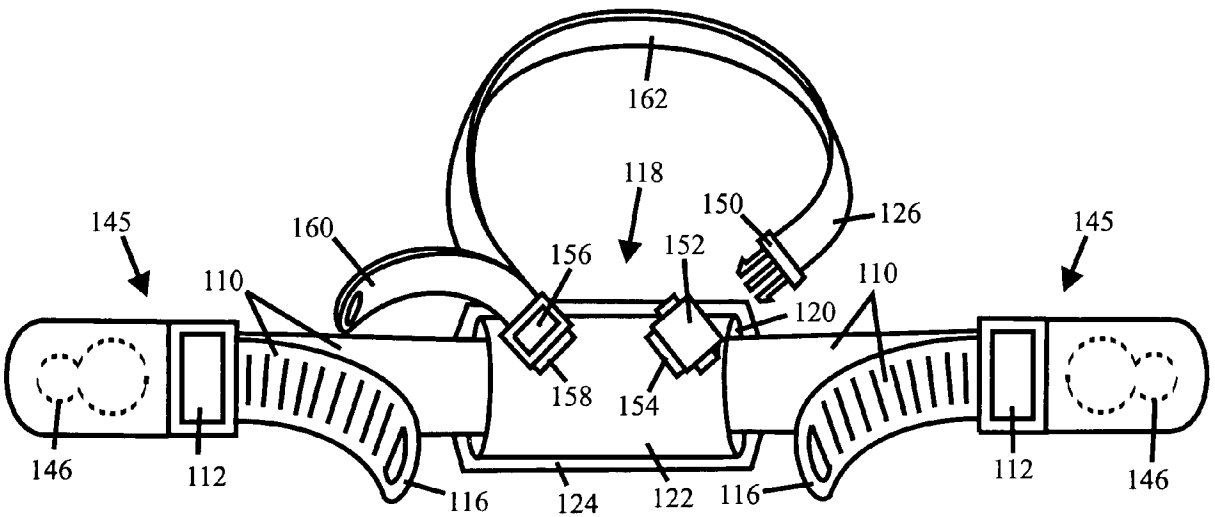
FIG. 3 shows a rear view of alternate embodiment dual adjustable heel strap and instep strap.

FIG. 3 shows a rear view of alternate embodiment of an adjustable buckle assembly 145. A non-quick release buckle connector 146 is connected to Buckle 112. An instep strap 143 is used. A post receiving cavity 148 is located on the opposite side of connector 146. Cavity 148 is displayed by a dotted line and may have any desired shape. Instead of using a post connection, buckle 112 may be connected directly to the swim fin, connected to a section of strap material that is riveted or bolted to the swim fin, pinned to the swim fin, or is molded to the swim fin. A quick release male connector 150 is connected to instep strap 143. A quick release female connector 152 is connected to pad 118 with a connector base 154. An adjustable buckle 156 is connected to pad 118 with a connector base 158. Connector bases 154 and 158 are preferably made with fabric sewn to pad 118; however any method of connection may be used, including any chemical or mechanical bond. An instep strap end 160 is located adjacent buckle 156. In alternate embodiments, an additional quick release connector may be attached to buckle 156 in order to permit instep strap 143. An inside surface 162 is preferably padded with a soft material.

SUMMARY, RAMIFICATIONS, AND SCOPE

Accordingly, the reader will see that the methods of the present invention provide a highly adjustable strap connection harness network that offer numerous advantages in that they:

(a) provide swim fin adjustable strap structures that are easy to put on and take off in the water;

(b) provide swim fin adjustable strap structures having increased security for prevention of loss of fins in rough water conditions;

(c) provide swim fin adjustable strap structures that are adjustable in multiple ways and dimensions relative to the user's ankle, including sizing, tightness, security, comfort and positioning;

(d) provide swim fin adjustable strap structures that reduce play between the foot and the swim fin with improved adjustability and support, thus increasing propulsion efficiency by reducing lost motion, chaffing and blisters;

(e) provide swim fin adjustable strap structures that can be adjusted in the water to provide fine-tuned fit around the heel and ankle for maximum security, efficiency, and comfort;

(f) provide swim fin adjustable strap structures that provide a more solid grip around the ankle so that increased leverage can be applied to the swim fin blade for increased power, speed, torque and control;

(g) provide swim fin adjustable strap structures that permit surf fins to be made with injection molded thermoplastics for increased manufacturing efficiency and style while also providing improved security from losing such surf fins in large surf conditions;

(h) provide swim fin adjustable strap structures that have sufficient adjustability to permit a lower quantity of foot pocket cavity sizes to fit a larger array of foot sizes and shapes;

(i) provide improved ankle support with adjustability on both the heel and the instep of the ankle;

(j) provide swim fin adjustable strap structures having adjustability in numerous dimensions for improved comfort, adaptability, and support;

(k) provide improved leverage on the swim fin blade during kicking from the instep portion of the ankle through adjustable strap structures that can be adjusted on both sides of the ankle to significantly reduce loose play between the blade and the ankle; and (l) provide dual adjustable heel strap and instep strap foot attachment assemblies that permit each portion to be easily adjusted without impeding the function or adjustment of the other portion.

Although the description above contains many specificities, these should not be construed as limiting the scope of the invention but as merely providing illustrations of some of the presently preferred embodiments of this invention.

In addition, any of the embodiments and individual variations discussed in the above description may be interchanged and combined with one another in any desirable order, amount, arrangement, and configuration. For example, the heel pad and instep strap assemblies can be made to be completely removable from the heel strap without disconnecting the ends of the heel strap or without having to slide the heel strap through the heel pad. An access slot or opening with a locking device can be used to connect the instep strap to the heel slide the heel strap through any structure. Also, the instep strap and adjustment buckles can be secured directly to the heel strap without using a heel pad.

These can be removable, adjustable or permanent connections. In other alternate embodiments, the buckles, quick disconnect structures, or locking features can be located at any position along the heel strap and instep strap. The instep strap can also be molded together with the heel strap with one piece of thermoplastic elastomer, thermoplastic rubber, compression molded rubber, or cut out of one piece of woven material, plastic sheeting, rubber sheeting, laminate sheeting, or other suitable materials. In such situations, the instep strap could be made with a highly elastic material capable of stretching and therefore not need an adjustment end and could just be a closed loop of material created at the same time as the heel strap.

Accordingly, the scope of the invention should not be determined not by the embodiments illustrated, but by the appended claims and their legal equivalents.

I claim:

1. An improved strap assembly for a swim fin, comprising:

(a) an adjustable heel strap having two distal ends arranged to be secured to two lateral sides of a swim fin foot pocket, said adjustable heel strap having a predetermined heel strap tension between said two lateral sides, at least one of said two distal ends having an adjustable heel strap buckle arranged to adjust said predetermined heel strap tension;

(b) an instep strap secured to said adjustable heel strap with an instep strap connection located between said distal ends, said instep strap secured to said heel strap at an instep strap base, said instep strap having a free end portion spaced from said instep strap base and said adjustable heel strap, said free end portion being secured to an adjustable instep buckle, said adjustable instep strap being capable of securing to the ankle of a swimmer with a loop having a predetermined instep strap tension between said instep strap base and said adjustable instep buckle, said instep buckle being arranged to permit said predetermined instep strap tension to be significantly adjustable, said instep strap connection being sufficiently spaced from said adjustable heel strap buckle to permit said adjustable heel strap buckle to efficiently adjust a significant amount of said predetermined heel strap tension.

2. The strap assembly of claim 1 wherein said instep strap connection is a heel pad.

3. The strap assembly of claim 2 wherein said heel pad has an opening for receiving said adjustable heel strap.

4. The strap assembly of claim 3 wherein said opening is movable relative to said adjustable heel strap has said predetermined heel strap tension is adjusted with said adjustable heel strap buckle.

5. The strap assembly of claim 4 wherein said opening is a sleeve structure made of fabric.

6. The strap assembly of claim 5 wherein a heel cushion is sewn to said sleeve.

7. The strap assembly of claim 6 wherein said adjustable instep buckle is secured to said heel pad with a quick release connector.

8. The strap assembly of claim 6 wherein at least one of said two distal ends of said heel strap is arranged to be removable from said lateral sides of said swim fin.

9. The strap assembly of claim 6 wherein said adjustable heel strap buckle is secured to both of said two distal ends of said adjustable heel strap.

10. The strap assembly of claim 6 wherein said instep strap base is secured to said heel pad with a quick release connector.

11. The strap assembly of claim 1 wherein said instep strap base is secured to said heel pad with a quick release connector.

12. A method for providing an improved strap assembly for a swim fin, comprising:

(a) providing an adjustable heel strap having two distal ends arranged to be secured to two lateral sides of a foot pocket on an adjustable swim fin, said adjustable heel strap having a predetermined heel strap tension between said two lateral sides, at least one of said two distal ends having an adjustable heel strap buckle arranged to adjust said predetermined heel strap tension;

(b) connecting an instep strap secured to said adjustable heel strap with heel pad located substantially between said distal ends, said heel pad having lateral side edges, said instep strap secured to said heel pad at an instep strap base, said instep strap having a free end portion spaced from said instep strap base and said heel pad, said free end portion being secured to an adjustable instep buckle, said adjustable instep strap being capable of securing to the ankle of a swimmer with a loop having a predetermined instep strap tension between said instep strap base and said adjustable instep buckle, said instep buckle being arranged to permit said predetermined instep strap tension to be significantly adjustable, said lateral side edges of said heel pad being sufficiently spaced from said adjustable heel strap buckle to permit said adjustable heel strap buckle to efficiently adjust a significant amount of said predetermined heel strap tension without interference from said heel pad.

13. The method of claim 12 wherein said heel strap is made with a fabric material.

14. The method of claim 13 wherein said heel pad has a closed sleeve arranged to secure said heel pad to said adjustable heel strap.

15. The method of claim 12 wherein said heel pad is located at a predetermined height along the heel portion of a swimmer's foot, said adjustable heel strap buckle and said adjustable instep strap buckle are arranged to permit said predetermined height to be adjusted by adjustment of said predetermined heel strap tension and said predetermined instep strap tension.

16. The method of claim 12 wherein said adjustable heel strap buckle and said adjustable instep strap buckle are arranged to significantly prevent said adjustable swim fin from being lost while swimming in large waves.

17. The method of claim 12 wherein said instep strap is secured to said heel pad with a quick release connector arranged to permit efficient connection and disconnection while in the water.

18. The method of claim 12 wherein said adjustable instep buckle is secured to said heel pad with a quick release connector arranged to permit efficient connection and disconnection while in the water.

19. The method of claim 12 wherein said predetermined heel strap tension is adjusted by said adjustable heel strap buckle and said predetermined instep strap tension is adjusted by said adjustable instep strap buckle in an amount sufficient to significantly reduce the amount of lost motion between said adjustable swim fin and the swimmer's foot.

20. The method of claim 14 wherein said predetermined heel strap tension is adjusted by said adjustable heel strap buckle and said predetermined instep strap tension is adjusted by said adjustable instep strap buckle in an amount sufficient to permit the swimmer's instep region of the ankle to apply increase leverage upon said adjustable swim fin during kicking strokes.

21. The method of claim 12 wherein said heel pad is relatively narrow in a lateral direction.

* * * * *